US006536554B2

(12) United States Patent
Andrews et al.

(10) Patent No.: US 6,536,554 B2
(45) Date of Patent: Mar. 25, 2003

(54) LOUDSPEAKER

(76) Inventors: Anthony John Andrews, "Hoyle", Horsham Road, Beare Green, Dorking, Surrey (GB), RH5 4PS; John Newsham, "Hoyle", Horsham Road, Beare Green, Dorking, Surrey (GB), RH5 4PS; Toby Charles Colingwood Hunt, Chowles Court, East Street, Rusper, Horsham, West Sussex (GB), RH12 4RH ( * ) Notice: Subject to any disclaimer, the term of this patent is extended or adjusted under 35 U.S.C. 154(b) by 0 days.

(21) Appl. No.: 09/881,660

(22) Filed: Jun. 14, 2001

(65) Prior Publication Data

US 2002/0189895 A1 Dec. 19, 2002

(30) Foreign Application Priority Data

Jun. 16, 2000 (GB) ..... 0014634

(51) Int. Cl.[7] ..... A47B 81/06
(52) U.S. Cl. ..... 181/199; 181/144
(58) Field of Search ..... 181/144, 145, 181/148, 154, 199

(56) References Cited

U.S. PATENT DOCUMENTS

| | | | | | |
|---|---|---|---|---|---|
| 4,139,734 | A | * | 2/1979 | Fincham | 181/145 |
| 4,475,761 | A | * | 10/1984 | Milroy et al. | 296/61 |
| 4,653,606 | A | * | 3/1987 | Flanagan | 181/145 |
| 4,730,693 | A | * | 3/1988 | Kobus | 181/145 |
| 5,714,723 | A | | 2/1998 | Kang | |
| 5,758,852 | A | * | 6/1998 | Martin | 181/199 |
| 5,996,728 | A | | 12/1999 | Stark | |
| 6,385,326 | B1 | * | 5/2002 | Peng | 181/199 |

* cited by examiner

*Primary Examiner*—Kim Lockett
(74) *Attorney, Agent, or Firm*—Andrus, Sceales, Starke & Sawall

(57) ABSTRACT

A loudspeaker comprises an electroacoustic driver in an enclosure having upper and lower ends. Plates are provided at one end and fixing devices are provided at the other end of the enclosure. The plates have holes which allow them to pass over fixing devices of a vertically adjacent loudspeaker. Each of the fixing devices comprises a pillar for passing through the hole of the plate of a vertically adjacent loudspeaker and a locking element connected to the pillar and moveable between an unlocked position for passing through the hole and a locked position for holding the plate on the pillar.

21 Claims, 10 Drawing Sheets

LOUDSPEAKER

The present invention relates to a loudspeaker. Such a loudspeaker may be used in a high quality public address system, for example for amplifying or reproducing music with high quality and at high sound levels.

In public address systems for use in large venues, such as in large auditoria or outdoors, where high sound levels and/or large audiences are to be covered, it is known to use arrays of loudspeakers mounted above the ground or "overhead" and suspended from above. In the case of such arrays of loudspeakers, the loudspeakers are arranged as one or more columns and are required to be angled relative to each other so as to provide the desired distribution of sound.

Typically, each column comprises a top loudspeaker which is attached to a frame by steel links such as chains. The other loudspeakers of the column are attached to each other by such links and by pivotal arrangements at their rears. In order to deploy some systems of this type, the frame is attached at ground level to a lifting arrangement and the speakers are mounted, a level at a time, to the frame or to the loudspeakers above by the links. After each level of loudspeakers has been mounted in this way, the frame is lifted to allow room for the next level of loudspeakers to be mounted. In other systems of this type, the speakers are attached to each other on the ground to form an array and are then lifted into position.

When the or each column is lifted off the ground, the loudspeakers are tilted with respect to each other in a vertical plane. If the tilt angles have subsequently to be changed, this may only be achieved by lowering the column to the ground and releasing tension in the links so that the loudspeakers rest on top of each other. The links may then be changed in length or replaced by links of a different length in order to alter the relative tilt angles. The column is then lifted off the ground and raised to the desired operating position. This is an inconvenient and time-consuming operation.

Such mounting arrangements require that large numbers of external components have to be transported. Such components can easily be lost in transit, during deployment and during disassembly of systems of this type.

According to the invention, there is provided a loudspeaker comprising at least one electroacoustic driver and an enclosure which, when oriented for normal use, has an upper end and a lower end, the enclosure having a connection arrangement comprising first and second plates disposed at one of the upper and lower ends, first and second fixing devices disposed at the other of the upper and lower ends, and first and second locking elements, each of the first and second plates having a hole for cooperating with another fixing device of the same type as the first and second fixing devices, each of the first and second fixing devices comprising a pillar fixed to the enclosure for passing through the hole of another plate of the same type as the first and second plates, each of the first and second locking elements being moveable to a locked position for holding the plate on the pillar.

Each of the first and second plates may be pivotable between a deployed position for cooperating with the other fixing device and a stowed position. Each of the first and second plates may be biased towards the stowed position. The enclosure may have at least one recess for receiving the first and second plates when in the stowed position.

The one of the upper and lower ends may have an external surface at which the first and second plates are disposed.

The first and second locking elements may be undetachably connected to the pillars of the first and second fixing devices, respectively. Each of the first and second locking elements may be movable between an unlocked position for passing through the hole of the other plate and the locked position. Each of the first and second locking elements may be pivotable about an axis which is substantially horizontal when the enclosure is oriented for normal use. Each of the first and second locking elements may be slidable downwardly, when the enclosure is oriented for normal use, to the locked position.

The pillar of each of the first and second fixing devices may extend from a surface of the enclosure which is substantially vertical when the enclosure is oriented for normal use. The surface may face and be accessible from the rear of the enclosure.

The first and second plates and the first and second fixing devices may be disposed substantially in a common plane which is substantially transverse to a front/rear axis of the loudspeaker. The loudspeaker may have a centre of gravity which is substantially at or adjacent and in front of the common plane. The first and second plates and the first and second fixing devices may be attached to a rectangular frame, for example of metal. The enclosure may comprise a plurality of panels, for example of wood, attached to the frame.

The loudspeaker may have a lower panel and an upper panel which has a front portion substantially parallel to the lower panel and a rear portion inclined towards the lower panel.

The loudspeaker may comprise a spacer device at the upper or lower end of the enclosure for controlling the tilt, about a substantially horizontal axis transverse to the front/rear axis of the loudspeaker, relative to an adjacent loudspeaker when the loudspeaker is connected to the adjacent loudspeaker. The spacer device may be disposed at the rear of the enclosure. The spacer device may comprise a slideable tongue for abutting against the adjacent loudspeaker. The spacer device may comprise a detent arrangement for holding the tongue in any selected one of a plurality of positions.

It is thus possible to provide a loudspeaker which is capable of being assembled into an overhead array with ease. The connection arrangement allows accurate and easy setting and resetting of the angle of tilting of each loudspeaker of the array. For example, in order to change the relative tilt angles, it is merely necessary for any tensioning of the loudspeakers to be relaxed without having to lower the column or array to the ground. The spacer devices (when provided) may then be readjusted and any tensioning reapplied in order to change or reset the tilt angle. The whole fixing arrangement can be made as part of the loudspeaker so that separate mounting components do not need to be provided and there is no risk of loosing any part of the mounting system. Loudspeaker arrays can therefore be assembled, adjusted and disassembled quickly and easily.

The invention will be further described, by way of example, with reference to the accompanying drawings, in which.

Figure 1:
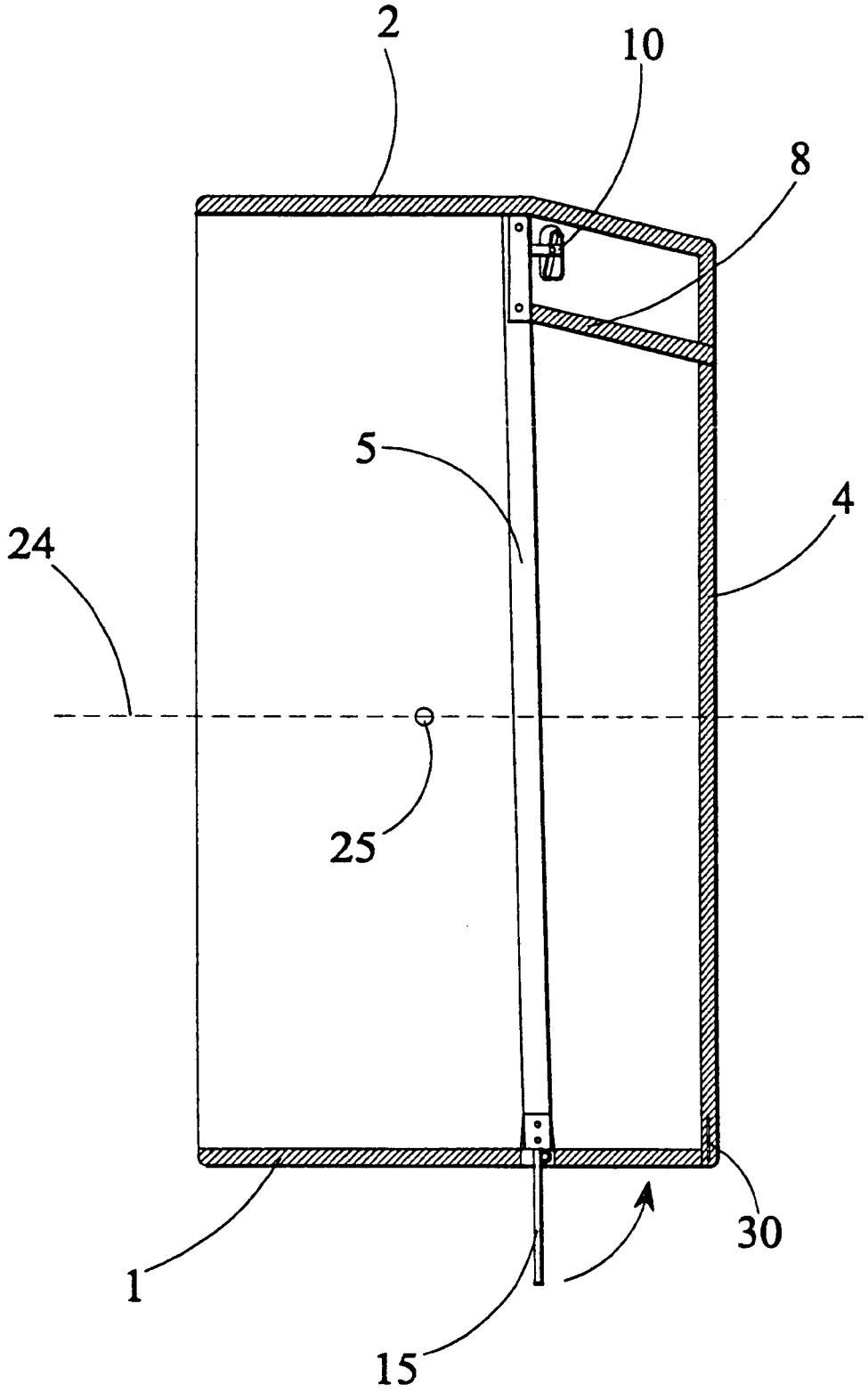
FIG. 1 shows a part sectional elevation of a loudspeaker constituting an embodiment of the invention.
Figure 2:
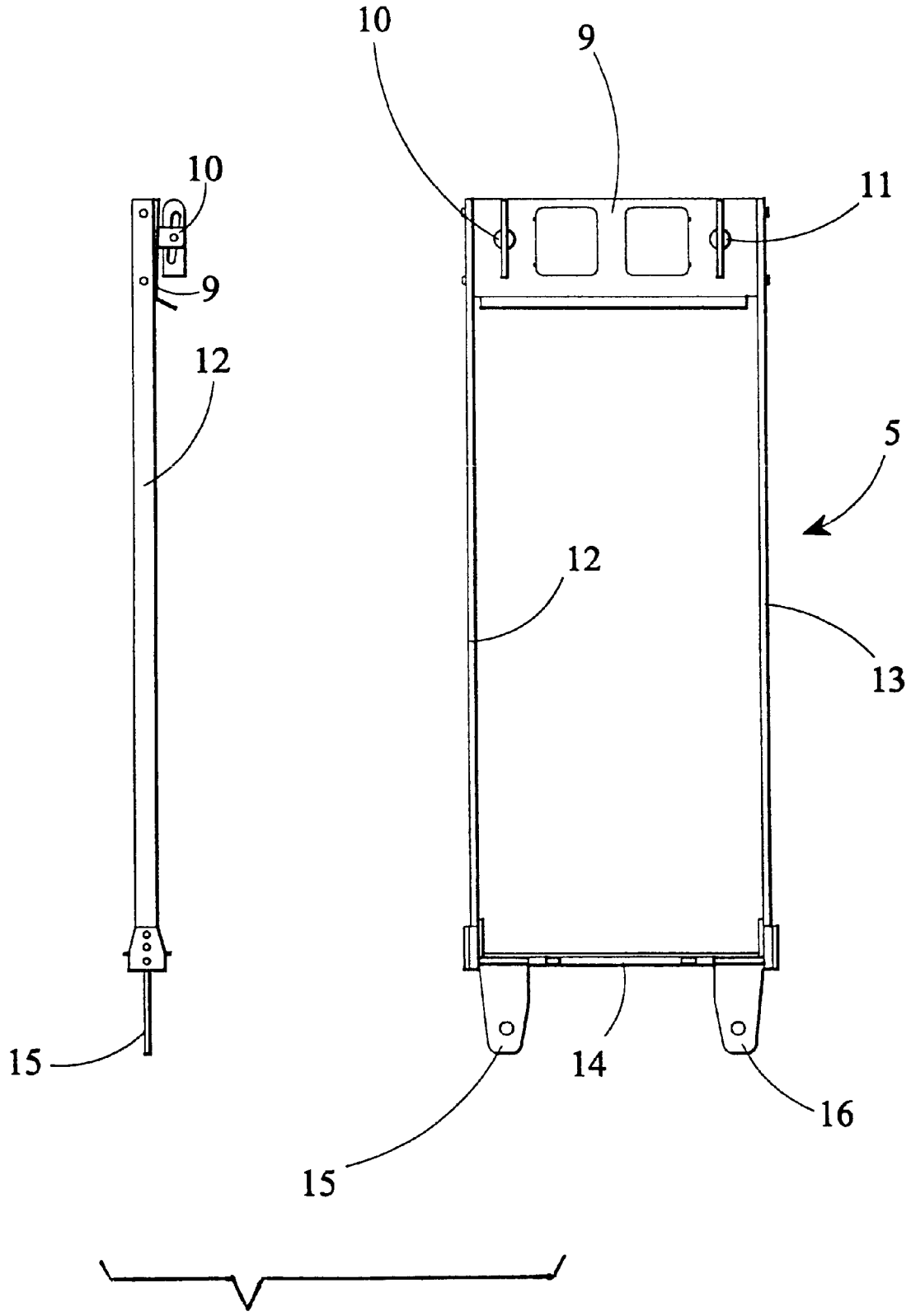
FIG. 2 shows side and rear views of a frame of the loudspeaker of FIG. 1.

FIG. 1 illustrates a loudspeaker comprising an enclosure and one or more electroacoustic drivers. For the purpose of clarity of illustration, the drawings do not show the driver or drivers and internal panels or baffles and other internal components. The enclosure comprises a lower or bottom panel 1, an upper or top panel 2 comprising a front portion which is substantially parallel to the lower panel 1 and a rear portion which is inclined downwardly towards the lower panel, side panels 3 and a rear panel 4. The side panels 3 and the rear panel 4 extend upwardly from and are perpendicular to the bottom panel 1. The panels 1, 2 and 3 are attached to a rectangular metal frame 5 whereas the rear panel 4 is attached to the other panels 1, 2 and 3.

The upper end of the enclosure is formed with two symmetrically arranged corner recesses defined by a substantially vertical upper frame member 9, a substantially vertical panel 7 and an inclined panel 8. Fixing devices 10 and 11 are attached to the frame member 9, for instance by means of a screw and thread arrangement. For example, each of the fixing devices 10 and 11 may have a threaded shaft which is secured by a nut 27.

The upper frame member 9 is connected by side frame members 12 and 13 to a lower frame member 14. Plates 15 and 16 are mounted on the lower frame member 14 so as to be pivotable about a common horizontal axis. The plates 15 and 16 are pivotable between a deployed position, in which they hang generally vertically downwardly from the lower panel 1, and a stowed position to which the plates are spring-biased. The lower panel 1 is provided with a recess illustrated at 17 in FIG. 5 for receiving each of the plates 15 and 16 when in its stowed position so that nothing protrudes below the lower surface of the bottom panel 1 when the loudspeaker is disconnected from other loudspeakers, for example for transportation.

The fixing devices 10 and 11 are of a type known as an "Antiluce" (RTM) catch commonly used on lorries or trucks. Each fixing device comprises a pillar 18, which is rigidly fixed to the frame member 9 as described hereinbefore, and a locking element 19. The locking element 19 is captive on or undetachable from the pillar 18. The locking element 19 is pivotably and slidably mounted on the pillar 18.

Each of the plates 15 and 16 has formed therein a hole 20 of a size such that the locking element 19 and the pillar 18 can pass therethrough. A slot 21 is formed in the locking element 19.

Figure 4:
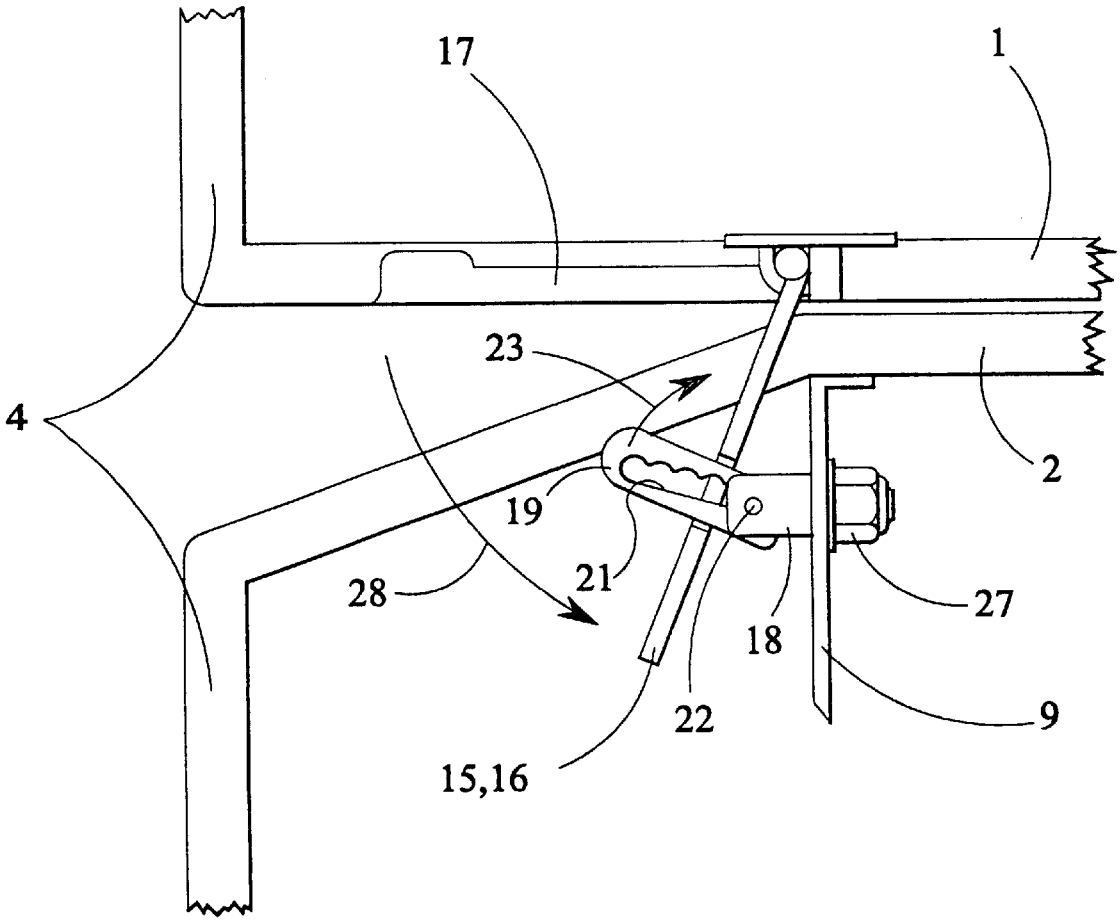
FIG. 4 is a part sectional view illustrating a fixing device of the loudspeaker of FIG. 1.

FIG. 4 illustrates the position of the locking element 19 for connecting and disconnecting two vertically adjacent loudspeakers of the same type or at least having the same fixing arrangement. In this position, the loudspeakers are positioned relative to each other so that the hole 20 in each of the plates 15 and 16 passes over the locking element 19 and over the pillar 18 as the plate is pivoted downwardly in the direction of arrow 28 so as to abut substantially against the frame member 9.

Figure 5:
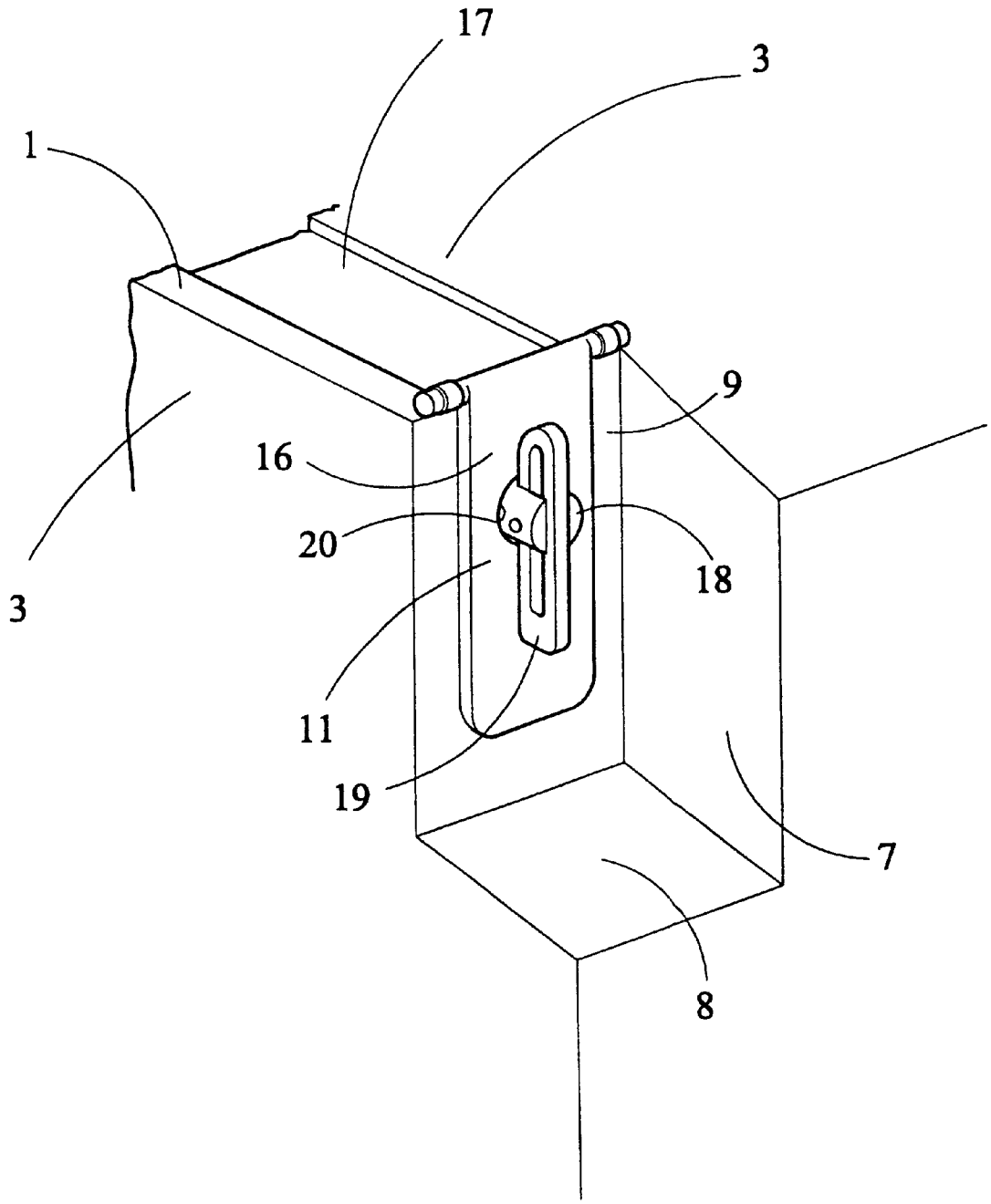
FIG. 5 is a rear view illustrating in more detail the interconnection of the loudspeaker of FIG. 3.

When the plates 15 and 16 are substantially against the frame member 9, the locking element 19 is pivoted about a spindle 22 in the pillar 18 in the direction of arrow 23 in FIG. 4 until the locking element 19 extends substantially vertically and lies against the plate 15 or 16. The locking element 19 is then slide downwardly to a position where it extends across and beyond the hole 20 and in which it is prevented from rotating on the pivot 22. The locking element 19 of each fixing device 10 and 11 thus locks or holds the plate 15 or 16 over the pillar 18 and against the frame member 9 with little or no play in the position of the plate 15 or 16. This position is illustrated in FIG. 5.

The slot 21 does not extend parallel to the longitudinal axis of the locking element 19 but is slightly inclined with one of its edges having a sinuous shape. Thus, as the locking element 19 is slide downwardly towards the position illustrated in FIG. 5, it pushes the plate 15 or 16 against the frame member 9 and the sinuous profile ensures that the locking element 19 is held at the position illustrated in FIG. 5 with very little play in the position of the plate 15 or 16.

The fixing devices 10 and 11 and the plates 15 and 16 are mounted on the rectangular frame 5 so as to lie substantially in a common plane which extends substantially perpendicularly or transversely to a front/rear axis of the loudspeaker illustrated at 24 in FIG. 1. The centre of gravity of the loudspeaker may be in plane defined by the frame 5 but is preferably adjacent this plane and in front of it as illustrated at 25 in FIG. 1.

Thus, when suspended from above by means of the cooperation between the fixing devices 10 and 11 of the loudspeaker and the plates 15 and 16 of a loudspeaker or frame immediately above the loudspeaker, the enclosure pivots or tilts backwardly by the pivoting action of the plates 15 and 16 so that the centre of gravity 25 lies vertically below the common pivotal axis of the plates 15 and 16 of the upper loudspeaker or a supporting frame above the loudspeaker.

Figure 6:
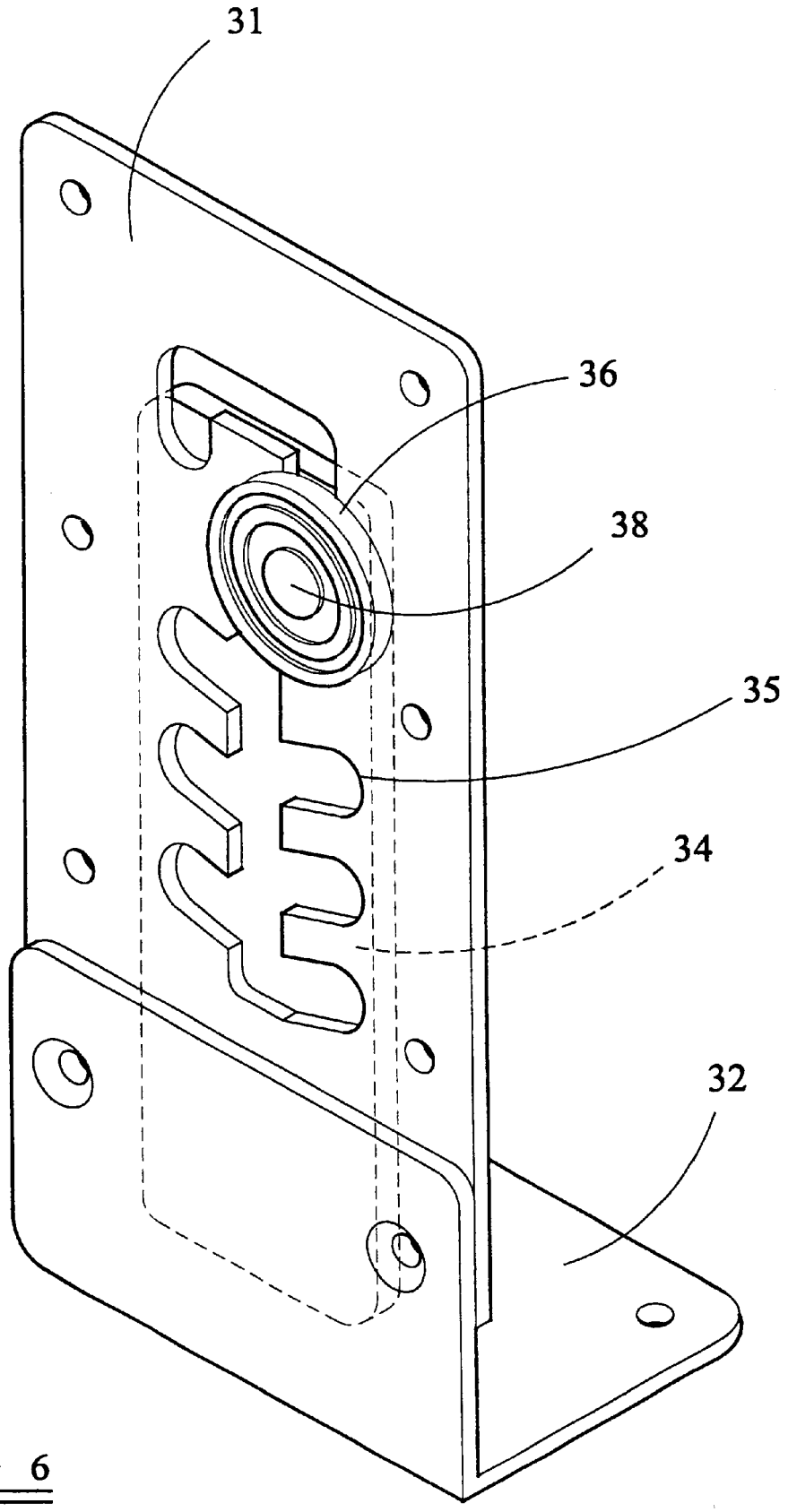
FIG. 6 is a rear view of a spacer device of the loudspeaker shown in FIG. 1.
Figure 7:
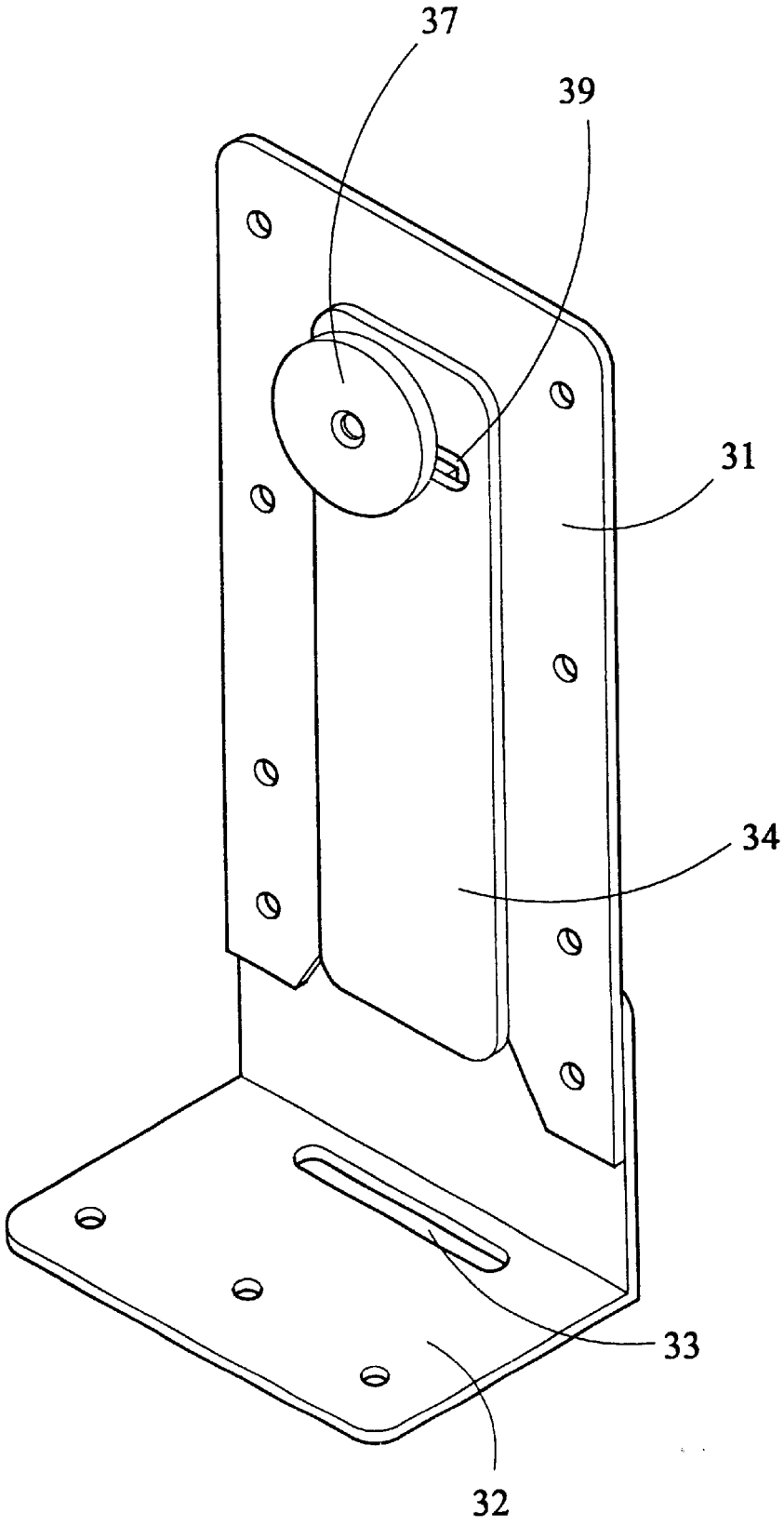
FIG. 7 is a front view of the spacer device of FIG. 6.
Figure 8:
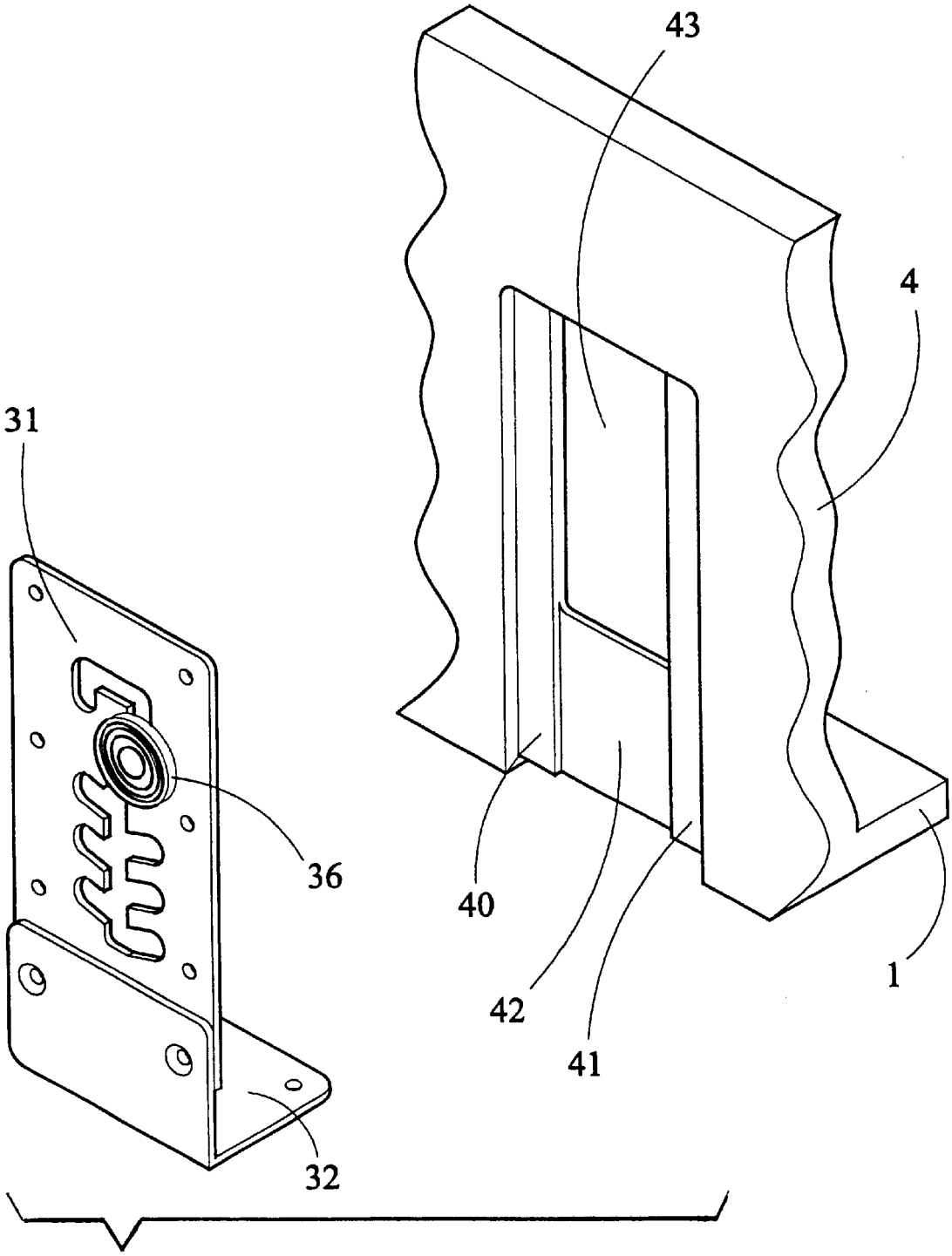
FIG. 8 is a part-exploded rear view illustrating attachment of the spacer device of FIG. 6 to the rear of the loudspeaker of FIG. 1.

A spacer device 30 is provided at the bottom rear of the panel 4 to provide an easy and convenient way of setting the angle of tilt between vertically adjacent loudspeakers. The spacer device 30 is shown in more detail in FIGS. 6 to 8 and comprises an index plate 31 attached to a base plate 32 to form an assembly which is attached to the bottom panel 1 and the rear panel 4 of the loudspeaker. The base plate has a slot 33 formed therein and a tongue 34 is mounted so as to be slidable vertically and, throughout a range of positions, to extend through the slot 33. An index slot 35 is formed in the index plate 31 and the tongue 34 is retained against the index plate 31 by means of front and rear knobs 36 and 37 connected together by a spindle 38 which passes through the index slot 35 and through a horizontal slot 39 in the tongue 34.

The recess in the rear panel 4 has several sections of different depths for accommodating the index plate 31, the tongue 34 and the knob 37 while constraining the tongue 34 for vertical sliding movement. In particular, the recess has relatively shallow portions 40 and 41 which receive the index plate 31 and define therebetween a vertical channel to prevent any substantial movement of the tongue 35 other than vertical sliding or translatory movement. The recess has a deeper portion 42 which allows the tongue 34 to move upwardly and downwardly and a deepest portion 43 to accommodate movement of the knob 37.

The index slot 35 comprises a main slot extending vertically and from which a plurality of upwardly inclined blind slots extend from different heights along the main slot. The upper part of the main slot has portions which may extend, in sequence, diagonally, vertically and horizontally ending in a downwardly extending blind slot.

Figure 3:
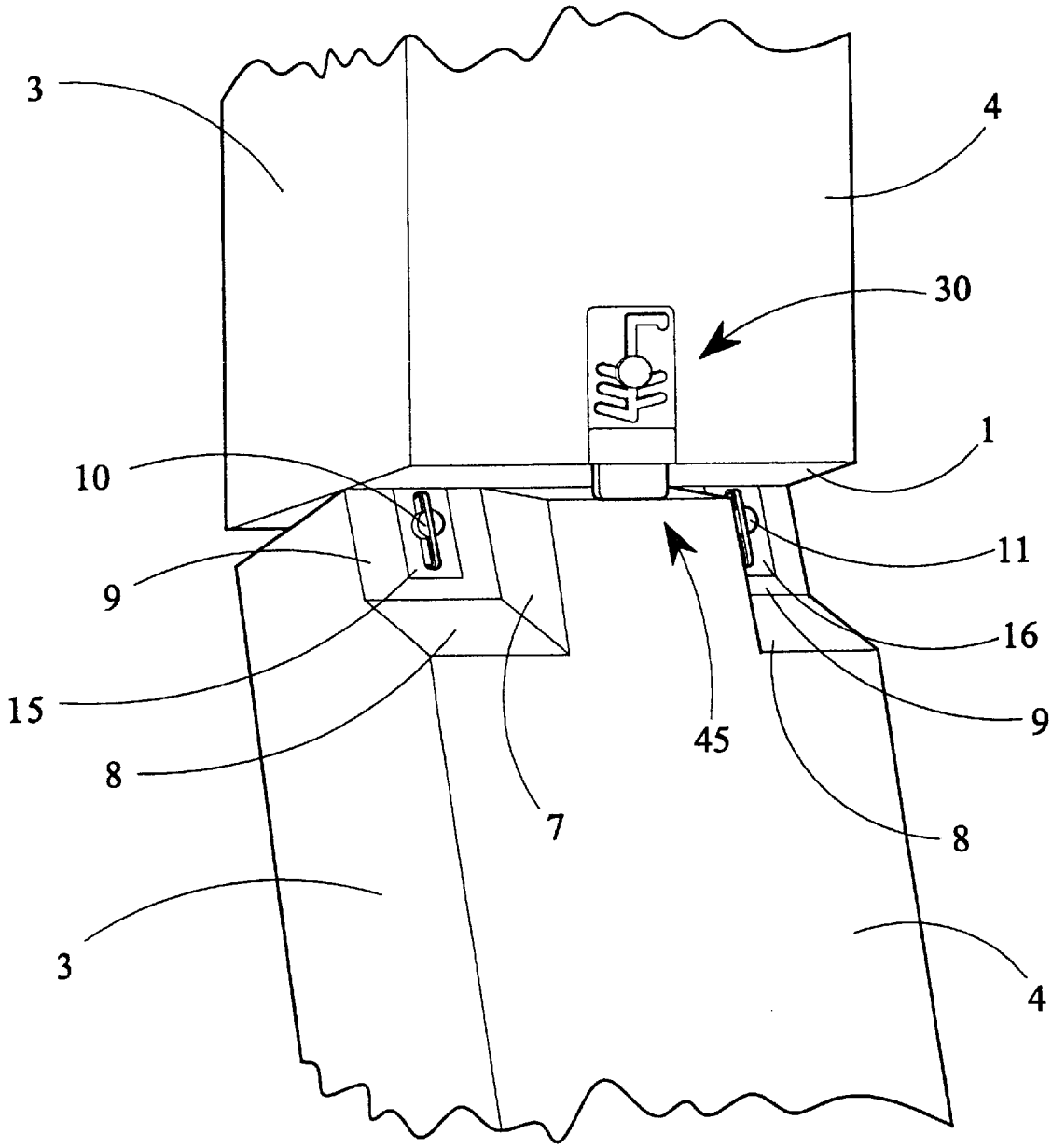
FIG. 3 is a rear view illustrating the interconnection between two loudspeakers of the type shown in FIG. 1.

When the tongue 34 is required to be retracted, for example for transportation or to permit the maximum relative angle of tilt between the loudspeaker to which the spacer device is attached and the loudspeaker immediately below, the knob 36 is used to pull the tongue out of the slot 33 and the end blind slot allows the tongue to be retained in the fully retracted position. When it is desired to set any other tilt angle, the tongue 34 is lowered through the slot 33 and the spindle 38 enters the appropriate blind slot of the main portion of the index slot 35. The end of the tongue thus acts as a stop for limiting the relative downward tilting of the lower loudspeaker to an angle determined by the extent to which the tongue 34 protrudes through the slot 33. In particular, a turning moment about the pivotal axis causes the portion 45 of the upper panel 2, as illustrated in FIG. 3, to abut against the tongue 34. The turning moment may result from the location of the centre of gravity of the loudspeaker, from tension applied by a tensioning strap as described hereinafter for urging the lower loudspeaker to tilt downwardly, or from a combination of the two. Retraction of the tongue is prevented by the spindle 38 being pressed against the end of the selected blind slot.

The lower edge of the index plate 31 is re-entrant so as to provide space for a spring which biases or urges the tongue 34 away from the index plate 31 and against the inner surface of the portion 42 of the recess in the rear panel 4. This provides a measure of frictional resistance to movement of the tongue 34 and takes up any play in the position of the tongue 34 perpendicular to its plane.

Figure 9:
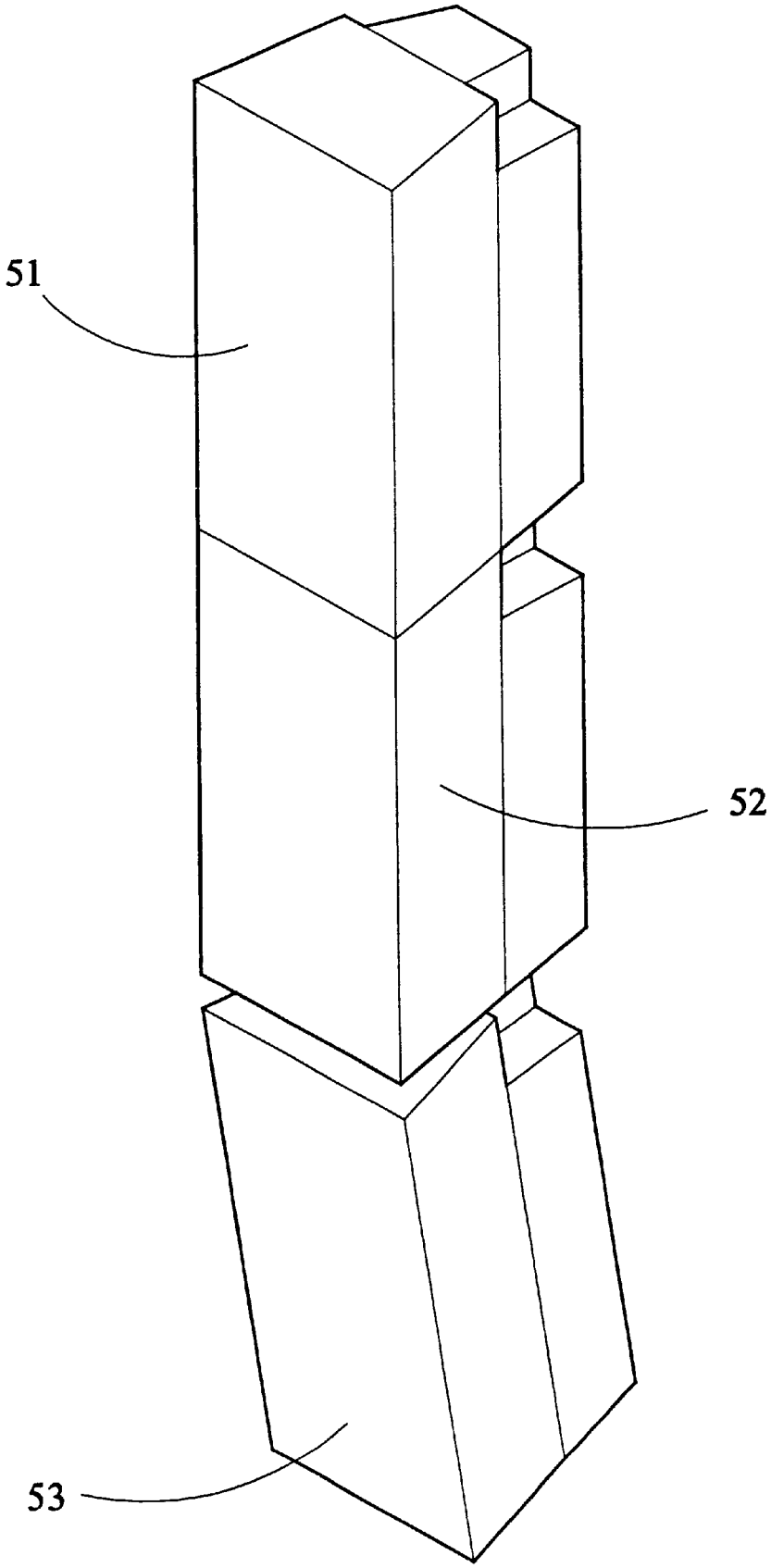
FIG. 9 is a general view of a column of loudspeakers of the type shown in FIG. 1.
Figure 10:
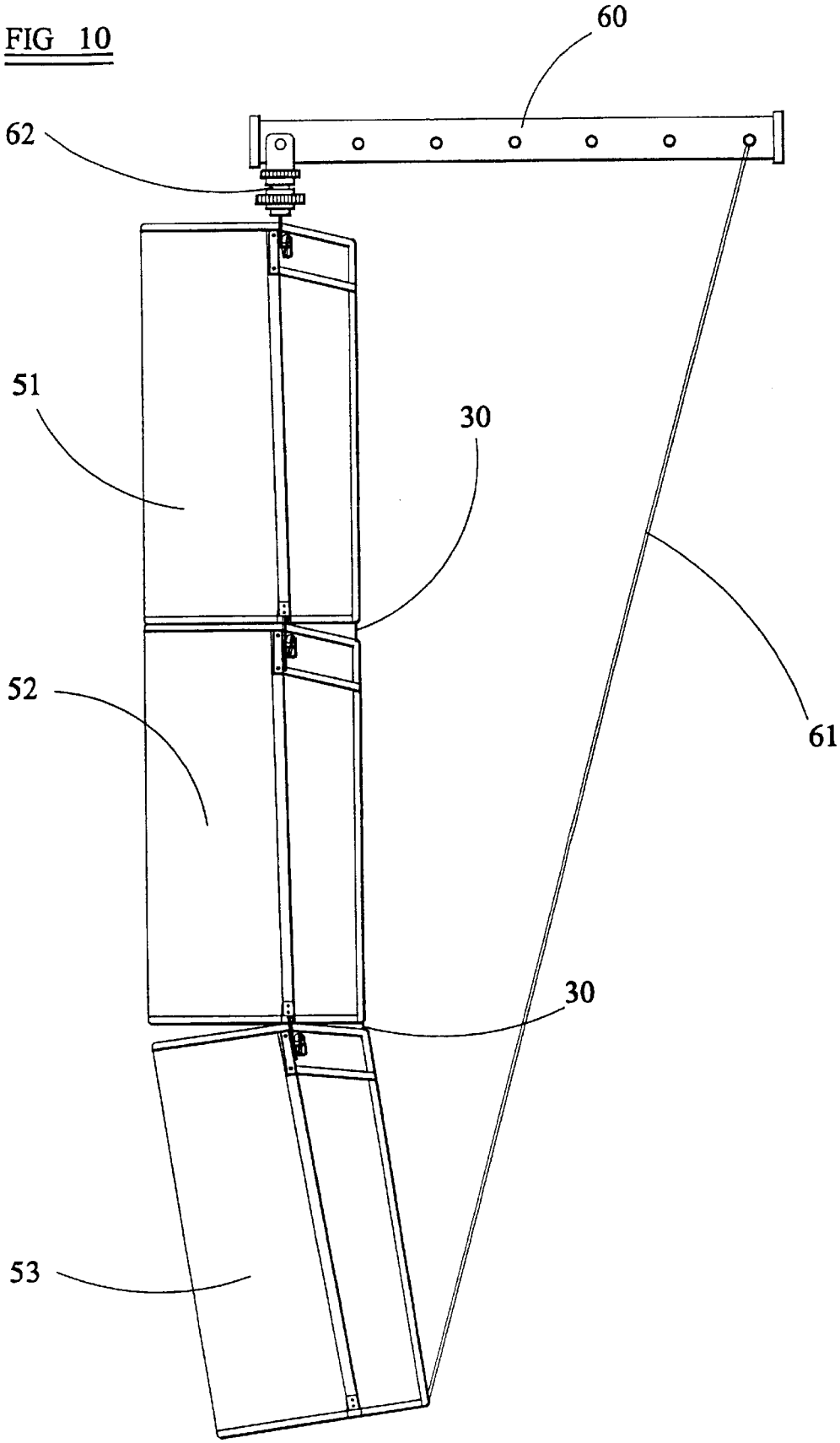
FIG. 10 is a more detailed part-sectional side view of the column of FIG. 9 and an overhead suspension arrangement.

FIG. 9 illustrates a column of loudspeakers 51 to 53 each of which is as illustrated in FIGS. 1 to 8 and as described hereinbefore. The top and middle loudspeakers 51 and 52 are required to have parallel front/rear axes and are therefore required not to have any relative tilt. The bottom loudspeaker 53 is required to be tilted relative to the loudspeaker 52. FIG. 10 illustrates the column of loudspeakers shown in FIG. 9 and also shows an overhead suspension frame 60 and a tensioning strap 61. The frame is provided with plates 62 of the same general type as the plates 15 and 16 and these are connected to the fixing devices 10 and 11 of the top loudspeaker 51. A tilting arrangement may be provided on the frame 60 so as to ensure that the top loudspeaker 51 is oriented with a desired tilt angle. This may be a spacer device of a type similar to that illustrated in FIGS. 6 to 8. As an alternative, the plate 62 may be fixable in any desired position over a range of pivotable positions. The loudspeaker 52 is connected to the loudspeaker 51 by the cooperation between the plates 15 and 16 of the loudspeaker 51 and the fixing devices 10 and 11 of the loudspeaker 52. The spacer device 30 on the loudspeaker 51 is set such that its tongue is in its lowest position so as to tilt the loudspeaker 52 about the pivotal axis of the plates 15 and 16 of the loudspeaker 51 so that the front portion of the upper panel of the loudspeaker 52 lies substantially flat against the lower panel of the loudspeaker 51.

The loudspeaker 53 is connected to and suspended from the loudspeaker 52 in the same way. However, the spacer device 30 of the loudspeaker 52 is set so that the tongue of the spacer device has an intermediate position for setting a desired angle of tilt between the loudspeakers 52 and 53. The bottom of the loudspeaker 53 is connected to the frame 60 by the tensioning strap 61 which is tensioned so as to ensure minimal relative movement between the loudspeakers 51 to 53 and so as to ensure that the tongues of the fixing devices 30 are held in position and the desired relative tilt angles are maintained.

In order to assemble and deploy the column of loudspeakers illustrated in FIGS. 9 and 10, and possibly other adjacent columns forming a two dimensional array suspended from a common suspension frame 60, the frame 60 is lowered so that the loudspeaker 51 can be connected to it. The tensioning strap 61 is attached at its upper end to the frame 60. The frame 60 with the attached loudspeaker 51 is then raised to a level such that the loudspeaker 52 can be manoeuvred relative to the loudspeaker 51 in order to connect them together. The spacer device 30 of the loudspeaker 51 is then set to the desired position. This is then repeated for the loudspeaker 53 and the lower end of the strap 61 is attached to the bottom of the loudspeaker 53. The strap is then tensioned and the frame 60 and suspended column of loudspeakers can be raised to the desired position.

It is also possible to deploy a column of loudspeakers at ground level, for example on the floor of a stage. It is typical for the floor of a stage to be above head height of an audience so that at least the bottom loudspeaker of a column is required to be tilted downwardly. The spacer device 30 may be used for this purpose with the tongue 34 extending through the slot 33 and abutting against the stage floor so as to angle the bottom loud speaker with the appropriate tilt. The loudspeakers above the bottom loudspeaker are connected together by means of the plates 15 and 16 and the fixing devices 10 and 11 as described hereinbefore and the spacer devices 30 may be used to set the required tilt angles. A tensioning strap may be used at the rear of the column of loudspeakers so as to ensure that the desired tilt angles are maintained and so as to prevent undesired forward tilting of the upper loudspeakers.

What is claimed is:

1. A loudspeaker comprising at least one electroacoustic driver and an enclosure which, when oriented for normal use, has an upper end and a lower end, said enclosure having a connection arrangement comprising first and second plates disposed at one of said upper end and said lower end, first and second fixing devices disposed on the other of said upper end and said lower end, and first and second locking elements, each of said first and second plates defining a hole for cooperating with a fixing device, each of said first and second fixing devices comprising a pillar fixed to said enclosure for passing through said hole, each of said first and second locking elements being movable to a locked position for holding said plate on said pillar.

2. A loudspeaker as claimed in claim 1, in which each of said first and second plates is pivotable between a deployed position for cooperating with said other fixing device and a stowed position.

3. A loudspeaker as claimed in claim 2, in which each of said first and second plates is biased towards said stowed position.

4. A loudspeaker as claimed in claim 2, in which said enclosure defines at least one recess for receiving said first and second plates when in said stowed position.

5. A loudspeaker as claimed in claim 1, in which said one of said upper and lower ends has an external surface at which said first and second plates are disposed.

6. A loudspeaker as claimed in claim 1, in which said first and second locking elements are undetachably connected to said pillars of said first and second fixing devices, respectively.

7. A loudspeaker as claimed in claim 1, in which each of said first and second locking elements is moveable between an unlocked position for passing through said hole of said other plate and said locked position.

8. A loudspeaker as claimed in claim 1, in which each of said first and second locking elements is pivotable about an axis which is substantially horizontal when said enclosure is oriented for normal use.

9. A loudspeaker as claimed in claim 1, in which each of said first and second locking elements is slidable downwardly, when said enclosure is oriented for normal use, to said locked position.

10. A loudspeaker as claimed in claim 1, in which said pillar of each of said first and second fixing devices extends from a surface of said enclosure which is substantially vertical when said enclosure is oriented for normal use.

11. A loudspeaker as claimed in claim 10, in which said surface faces and is accessible from a rear of said enclosure.

12. A loudspeaker as claimed in claim 1, in which said first and second plates and the first and second fixing devices are disposed substantially in a common plane which is substantially transverse to a front/rear axis of said loudspeaker.

13. A loudspeaker as claimed in claim 12, in which said loudspeaker has a centre of gravity which is substantially adjacent and in front of said common plane.

14. A loudspeaker as claimed in claim 12, in which said loudspeaker has a centre of gravity which is at said common plate.

15. A loudspeaker as claimed in claim 1, comprising a rectangular frame to which said first and second plates and said first and second fixing devices are attached.

16. A loudspeaker as claimed in claim 15, in which said enclosure comprises a plurality of panels attached to said frame.

17. A loudspeaker as claimed in claim 1, comprising a lower panel and an upper panel which has a front portion substantially parallel to said lower panel and a rear portion inclined towards said lower panel.

18. A loudspeaker as claimed in claim 1, comprising a spacer device at a first of said upper and lower ends of said enclosure for controlling a tilt, about a substantially horizontal axis transverse to a front to rear axis of said loudspeaker, relative to an adjacent loudspeaker when said loudspeaker is connected to said adjacent loudspeaker.

19. A loudspeaker as claimed in claim 18, in which said spacer device is disposed at a rear of said enclosure.

20. A loudspeaker as claimed in claim 18, said in which said spacer device comprises a slideable tongue for abutting against said adjacent loudspeaker.

21. A loudspeaker as claimed in claim 20, in which said spacer device comprises a detent arrangement for holding said tongue in any selected one of a plurality of positions.

* * * * *